United States Patent [19]

Liebermann et al.

[11] Patent Number: 4,546,815

[45] Date of Patent: Oct. 15, 1985

[54] CONTINUOUS CASTING USING IN-LINE REPLACEABLE ORIFICES

[75] Inventors: Howard H. Liebermann, Succasunna; James Riesenfeld, Basking Ridge, both of N.J.

[73] Assignee: Allied Corporation, Morris Township, Morris County, N.J.

[21] Appl. No.: 687,078

[22] Filed: Dec. 28, 1984

[51] Int. Cl.[4] ..... B22D 11/06

[52] U.S. Cl. ..... 164/463; 164/462; 164/423; 164/479; 164/429; 164/437; 164/488

[58] Field of Search ..... 164/462, 463, 423, 479, 164/429, 437, 488; 222/606, 607

[56] References Cited

U.S. PATENT DOCUMENTS

| | | | |
|---|---|---|---|
| 3,765,572 | 10/1973 | Neumann et al. | 164/336 X |
| 4,154,380 | 5/1979 | Smith | 222/591 |
| 4,229,231 | 10/1980 | Witt | 148/1.5 |
| 4,428,416 | 1/1984 | Shimanuki et al. | 164/461 |
| 4,433,715 | 2/1984 | Smith | 164/423 |

FOREIGN PATENT DOCUMENTS

| | | | |
|---|---|---|---|
| 57-171550 | 10/1982 | Japan | 164/423 |
| 1268178 | 3/1972 | United Kingdom | 164/437 |

*Primary Examiner*—Kuang Y. Lin

*Attorney, Agent, or Firm*—James Riesenfeld; Gerhard H. Fuchs

[57] ABSTRACT

An apparatus and method for permitting long-term continuous casting provides a plurality of orifices. By temporarily casting simultaneously from two adjacent orifices, it becomes possible to replace orifices without interrupting the casting process. Thus, the duration of continuous casting is not limited by the useful lifetime of a single casting orifice. Among the applications of the invention is the long-term continuous casting of metallic ribbon, such as amorphous metal ribbon.

29 Claims, 10 Drawing Figures

CONTINUOUS CASTING USING IN-LINE REPLACEABLE ORIFICES

DESCRIPTION

1. Field of the Invention

This invention relates to a method and apparatus for continuously forming a solid structure from a melt. It is particularly adapted for long-term continuous casting of metallic ribbon.

2. Description of the Prior Art

A common manufacturing goal is to move from a batch process to a continuous process to a long-term continuous process. The goal is particularly important in situations where high costs are associated with process startup and/or shutdown.

Metal casting is a process in which cost is impacted by the amount of material that can be produced continuously, without shutdown. Specifically, methods for making metal strip directly from the molten metal are known. These may involve, for example, jetting molten metal through an orifice and cooling it, either in free flight or by contact with a chill body, to obtain continuous filament. Some of these processes involve jetting of molten metal through an orifice under pressure. Typically, the molten metal is pressurized in a crucible, which has a bottom outlet in the form of an orifice in the shape of the desired cross section of the metal jet. Usually, the orifice of the casting nozzle is of small size, on the order of about 0.2 mm to about 1.0 mm in diameter, and tends to plug easily during operation. If a plug forms, casting of useable product ceases. Even in systems that incorporate replaceable nozzles (see e.g., U.S. Pat. Nos. 4,154,380; and 4,433,715), casting cannot begin again until a new nozzle is installed and the startup procedure is followed. Furthermore, plugging is only one of several nozzle failure modes. Consequently, a casting system that can operate continuously for periods longer than the useful lifetime of a casting nozzle is clearly desirable.

Methods for casting multiple layers of ribbon are known. For example, U.S. Pat. No. 4,229,231 issued Oct. 21, 1980, to Witt et al., discloses a melt-spinning technique that involves an array of orifices that successively deposit melt onto a moving surface to yield a multi-layered structure.

U.S. Pat. No. 4,428,416, issued Jan. 31, 1984, to Shimanuki et al., discloses a method of manufacturing multi-layer laminates of different metals or alloys, particularly where one of the layers is an amorphous alloy.

Neither Witt et al. nor Shimanuki et al. considered using a multi-orifice casting system to produce a single layer; on the contrary, it was precisely their goal to prepare multiple layers in a continuous process.

SUMMARY OF THE INVENTION

In accordance with the present invention, an apparatus for continuously forming a solid structure comprises:

(a) a plurality of vessels, each having an opening at one end in fluid communication with an orifice at another end, with the opening in each vessel adjoining the opening in each adjacent vessel, (b) means for directing a continuous stream of molten material and for moving the vessels relative to the stream, whereby the stream successively passes (i) into the opening and through the orifice of a first vessel only, (ii) into the openings and through the orifices of both the first vessel and a second vessel, and (iii) into the opening and through the orifice of the second vessel only, and (c) means for chilling the molten material that emerges from the orifices to effect quenching and solidification.

In an alternative embodiment, the apparatus comprises:

(a) a vessel that is adapted for holding molten material and that has an opening at one end and is adapted for fluid communication with a plurality of orifices at another end, (b) means for controlling the flow of molten material out of the vessel and through the orifices to successively provide a flow of molten material from (i) a first orifice only, (ii) the first orifice and an adjacent second orifice, and (iii) the second orifice only, and (c) means for chilling the molten material that emerges from the orifices to effect quenching and solidification.

In operation, a method is provided for continuously forming a solid structure, comprising the steps of:

(a) providing a continuous stream of molten material, (b) providing a first vessel and a second vessel, each vessel having an opening at one end and an orifice at another end and having their openings adjoining each other, (c) directing the stream toward the opening in the first vessel and moving the vessels relative to the stream, whereby the stream successively passes (i) into the opening and through the orifice of the first vessel only, (ii) into the openings and through the orifices of both the first and second vessels, and (iii) into the opening and through the orifice of the second vessel only, and (d) chilling the molten material that emerges from the orifices to effect quenching and solidification of the material.

An alternative method comprises the steps of:

(a) providing molten material in a vessel that has an opening at one end and is adapted for fluid communication with a plurality of orifices at another end, (b) controlling the flow of molten material out of the vessel and through the orifices to successively provide a flow of molten material from (i) a first orifice only, (ii) the first orifice and an adjacent second orifice, and (iii) the second orifice only, and (c) chilling the molten material that emerges from the orifices to effect quenching and solidification.

The process and apparatus of the present invention permit a casting orifice to be replaced without interrupting the casting process. Thus, they permit a casting process to continue for a period of time that exceeds the lifetime of a single casting orifice. In principle, the casting process may continue indefinitely, simply by replacing each orifice before there is a substantial likelihood of its failing (based on prior experience with orifice lifetimes).

DETAILED DESCRIPTION OF THE INVENTION

The present invention provides a casting apparatus and a method that overcome the limitation that orifice lifetime has heretofore placed on the maximum duration of continuous casting. That limitation is overcome by permitting the replacement of a casting orifice without interrupting the casting process. To simplify the explanation set forth below, the invention is described primarily in terms of metallic ribbon casting. However, as is clear to one skilled in the art, the process and apparatus need be limited neither to metals nor to ribbon. Thus, it is suitable generally for use with molten materials (metal or non-metal) that can be solidified by cooling. The solid may be in continuous form, such as fiber, wire, filament, etc.; or particulate form, such as flakes, powder, splats, etc.

Among the metal casting processes for which the present invention is well suited is the "planar flow casting" (PFC) method disclosed in U.S. Pat. No. 4,142,571, issued Mar. 6, 1979, to Narasimhan. That patent discloses an apparatus comprising a movable chill body, a slotted nozzle in communication with a reservoir for holding molten metal, and means for effecting expulsion of the molten metal from the reservoir, through the nozzle orifice, and onto the moving chill surface. The slotted nozzle is located in close proximity to the chill surface. The nozzle orifice of the PFC method is susceptible, as are orifices of the earlier-disclosed casting processes, to plugging problems. For PFC, just as for the other casting processes, the present invention permits longer-duration casting, without interruption for shutdown and startup.

Figure 1:
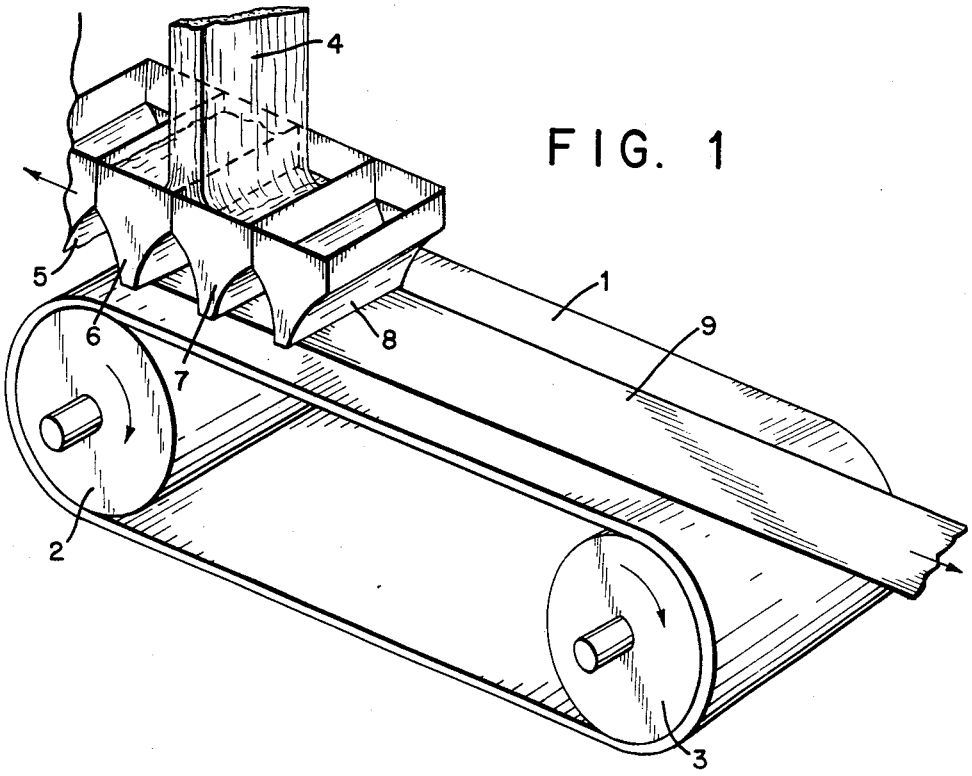
FIG. 1 depicts an embodiment of the present invention that makes use of a plurality of vessels.

FIG. 1 displays an embodiment of the present invention, as applied to PFC. The chill body is an endless belt 1 that is placed over rolls 2 and 3, which are caused to rotate by external means (not shown). A stream of molten metal 4 is provided from a source (not shown). A plurality of vessels 5, 6, 7, and 8 periodically move under the stream of metal in the direction shown by the arrow. (Alternatively, they could also move in the opposite direction). Preferably, stream 4 has a substantially rectangular cross section, with long and short sides parallel, respectively, to the long and short sides of a rectangular opening at the top of each vessel. Because of surface tension in the molten metal, achieving a rectangular cross section generally requires that the source of molten metal have a rectangular outlet and be located close to the vessel opening. Square corners on the rectangular outlet ought to be avoided in order to minimize the likelihood of cracking from thermal shock.

Any conventional conveyer means (not shown) may serve to move the vessels. The vessels are in contact along the sides that extend substantially normal to the direction of motion. The stream is positioned over the vessels so that the entire stream is received first in one vessel (e.g., vessel 6), then in two vessels (e.g., at the instant shown, vessels 6 and 7), then again in one vessel (e.g., vessel 7). The stream that enters the opening at the top of a vessel is cast from an orifice at its bottom and chilled to form a solid structure. The molten metal that emerges from the orifices may be chilled into a particulate form by a gas jet (see A. Lawley, *J. of Metals,* January, 1981, p. 13). Preferably, the metal is quenched on a moving chill surface to form solid ribbon. Preferably, the molten metal is selected from among those alloys that can be chilled rapidly to a solid ribbon that is at least 50% amorphous (see e.g., U.S. Pat. No. 3,856,513), and the chill rate is suitably rapid. So long as the flow rate into the vessel(s) remains constant, the rate of casting remains substantially constant, although, periodically, casting is from two orifices, with material from one orifice depositing onto material that was deposited from another. After casting from a vessel (for example vessel 5) has been completed, that vessel can be removed, or several used vessels can be removed as a unit. Similarly, vessels can be added to the train, either individually or in a group, to follow vessel 8.

Although the vessels may move continuously, in the preferred embodiment the vessels remain stationary, and casting is through a single vessel for an extended period of time. The vessels are moved when product defects show that an orifice requires replacement, or, if no such defects appear, then after a time that is shorter than, but determined by, the mean orifice lifetime. The vessels then move until the next vessel is positioned under stream 4. Thus, the interval during which casting is from two orifices is generally a small fraction of the casting time and, if necessary, material cast during that interval may be discarded. If ribbon is wound on cores, transfer winding can provide continuous ribbon takeup on successive cores without interrupting the windup process, and a simple relay system can ensure that material to be discarded is at the end of a roll, where it can easily be removed.

If necessary, a vessel orifice (or the entire vessel) may be heated before molten material is to pass through it, to prevent thermal shock, which could crack the vessel and/or distort the orifice. Heating may be accomplished by any suitable method known in the art, such as radiant heating, convection heating (e.g., by a hot gas), etc.

Figure 2:
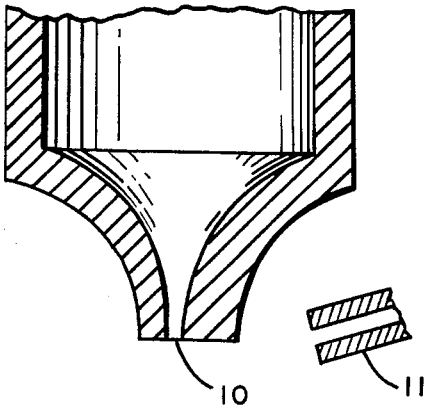
FIG. 2 depicts a cross section through the bottom of a vessel of FIG. 1.

FIG. 2 shows a cross section through the bottom of a vessel, showing narrow orifice 10. Orifice plugging is one of the failure mechanisms that is avoided by the use of this invention. In addition, all orifices that are elements of this invention avoid having sharp corners, where stress buildup can cause cracking. Also shown in FIG. 2 is a section of optional nozzle 11, from which a flame or hot gas can be directed at the bottom of the vessel in order to effect preheating of the orifice.

Figure 3:
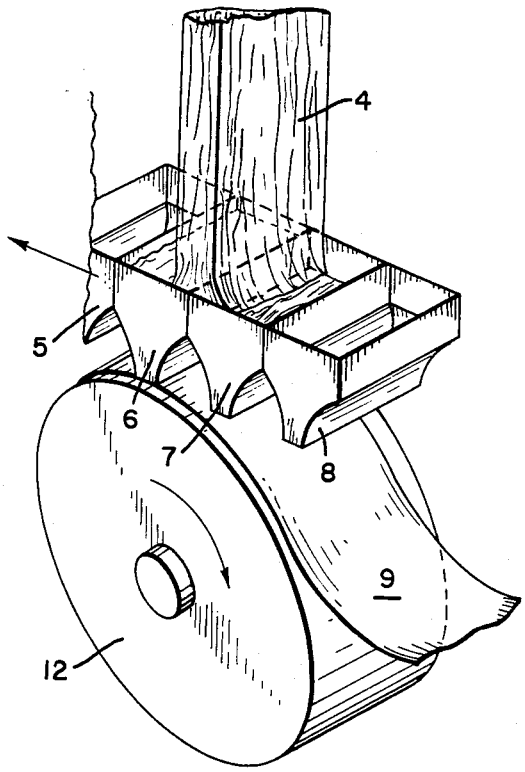
FIG. 3 depicts another embodiment involving a plurality of vessels.

The chill surface depicted in FIG. 1 is an endless belt; however, the chill surface may alternatively be a wheel, such as 12 shown in FIG. 3.

Figure 4:
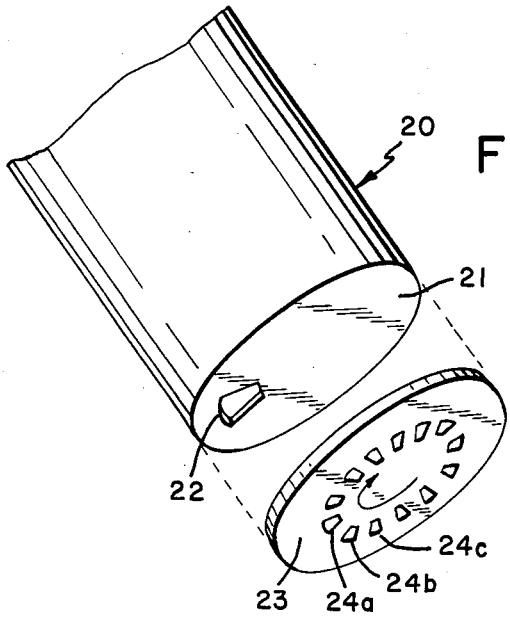
FIG. 4 depicts an embodiment of the present invention that makes use of a single vessel and a plurality of orifices.

FIG. 4 displays an exploded view of an embodiment of the present invention in which casting is from a single vessel 20. Vessel 20 has a bottom 21 that has a vessel opening 22. Mounted against bottom 21 is plate 23, which has a disk shape and has near its periphery a plurality of plate openings 24*a*, 24*b*, 24*c*, . . . Plate 23 is mounted so that it may be rotated about an axis that is normal to the disk. For clarity, plate 23 is shown separate from bottom 21, but, in reality, it is positioned below and in intimate contact with bottom 21.

Figure 5A:
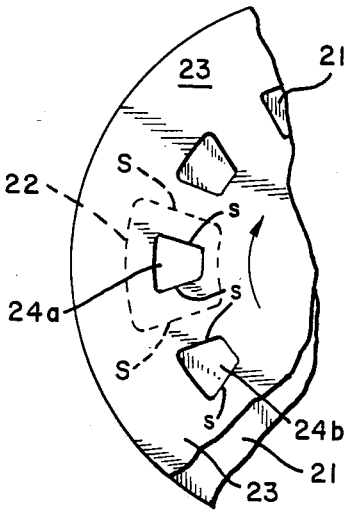
FIG. 5a and 5b depict two successive stages of casting with the apparatus of FIG. 4.
Figure 5B:
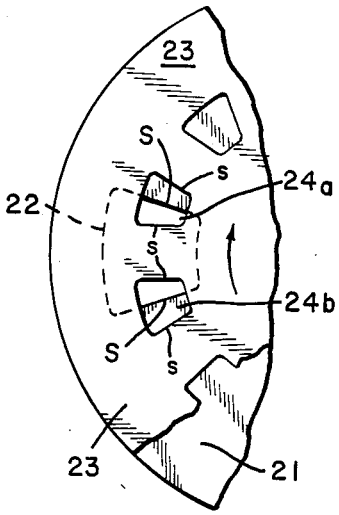

As is shown in FIG. 5*a*, the plate openings 24*a*, 24*b*, 24*c* . . . are positioned so that as plate 23 rotates, each plate opening in turn is below vessel opening 22. The plate openings are smaller than the vessel opening and are closely spaced one-to-another. Thus, as plate 23 rotates, there is an interval during which parts of two adjoining plate openings are both positioned below vessel opening 22 to carry fluid from vessel 20 (see FIG. 5*b*). Sides s of plate openings 24 and sides S of vessel opening 22 are preferably substantially radial to provide uniform flow. Plate openings preferably have no sharp corners, where stress buildup can cause cracking.

Figure 6:
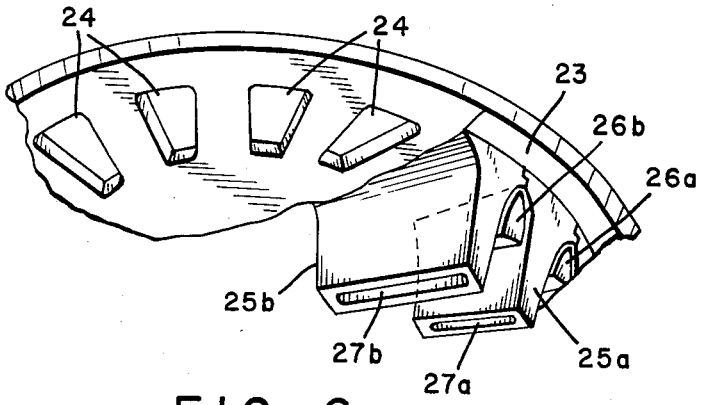
FIG. 6 depicts the nozzles of the apparatus of FIG. 4.

Although, for clarity, they are not shown in FIGS. 4 and 5, a casting nozzle is mounted below each plate opening. Two nozzles, 25*a* and 25*b*, are shown in FIG. 6. The nozzles are mounted onto the bottom of plate 23 so as to be easily replaced and to permit close spacing. If necessary, nozzle supports, 26*a* and 26*b* for example, are provided for mechanical support. A cutaway section shows plate openings 24, against which the nozzles are mounted. The chill surface (not shown) for solidifying the material that is cast from the nozzle orifices can be of conventional form, such as the endless belt 1, shown in FIG. 1, or the chill roll 12, shown in FIG. 3. The orifices are optionally preheated using, for example, the nozzle 11 shown in FIG. 2.

In operation, molten material is contained in vessel 20, before being passed through vessel opening 22, a plate opening and its accompanying nozzle and nozzle orifice (e.g., 24*a*, 25*a*, and 27*a*) onto a chill surface. After a time that is shorter than, but determined by (from prior experience), the expected useful life of the nozzle, plate 23 is rotated so as to move plate opening 24*b* and accompaning nozzle 25*b* into place below vessel opening 22. During the rotation, there is an interval during which casting from two adjoining nozzle orifices takes place (see FIGS. 5*a* and 5*b*). Preferably, that interval is short compared with the total casting time and, if necessary, means can be provided to identify and, ultimately, discard material cast from two orifices. As plate 23 rotates, used nozzles can be replaced with new nozzles, thus permitting continuous casting for a time interval that is not limited by the lifetime of a typical nozzle.

Figure 7:
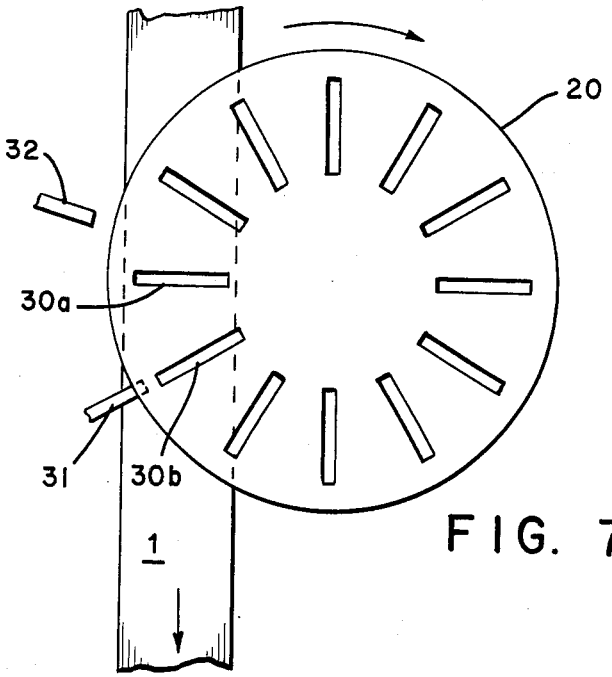
FIG. 7 depicts another embodiment of the invention that uses a single vessel and a plurality of orifices.

Another apparatus for the practice of this invention is depicted schematically in FIG. 7, which is a top view into rotatably mounted vessel 20, showing multiple orifices 30*a*, 30*b*, . . . in nozzles attached to the bottom of the vessel. When molten material is in the vessel, casting is accomplished through nozzle orifice 30*a* onto endless belt 1 to form ribbon (not shown). At the instant shown in the Figure, a conventional stopper rod (40 in FIG. 8) prevents material from flowing into nozzle orifice 30*b*, as the orifice is being preheated by optional heater 31. At a predetermined time, or when defective product indicates premature nozzle failure, vessel 20 is rotated in a clockwise direction. The stopper rod is lifted to permit flow of molten material through nozzle orifice 30*b*, and nozzle 30*a* is cooled by a coolant supplied, for example, from optional blower nozzle 32. Alternatively, a second stopper rod may be lowered to stop flow through nozzle orifice 30*a*. In either case, material freezes in nozzle orifice 30*a*, plugging the orifice and preventing further flow through it. Until the material stops flowing from nozzle orifice 30*a*, material is briefly cast from both orifices 30*a* and 30*b*. As the crucible continues sequentially rotating in a clockwise fashion, the solidified material in the nozzle prevents molten material in the vessel from passing through the nozzle orifice. When the frozen nozzle again reaches the position identified in FIG. 7 as 30*b*, the frozen nozzle is replaced with a new nozzle, after a stopper rod is lowered into the crucible to prevent molten material flow during nozzle replacement.

Figure 8:
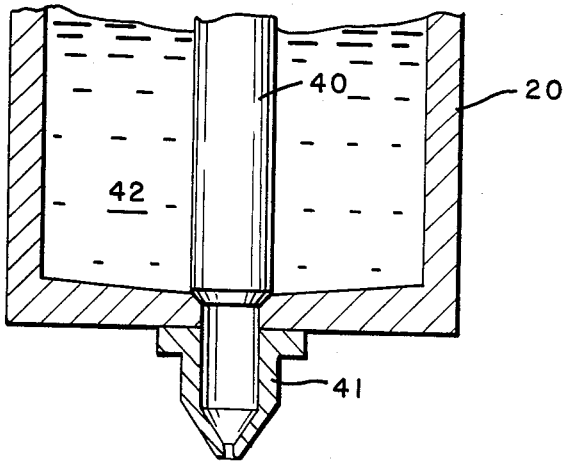
FIG. 8 is a cross section through an embodiment of the apparatus of FIG. 7.

FIG. 8 is a vertical section through the apparatus of FIG. 7 and depicts an embodiment of a stopper rod and replaceable nozzle arrangement that is suitable for the practice of this invention. Stopper rod 40 is shown lowered to the base of vessel 20, so that nozzle 41 may be replaced, while molten material 42 remains in the vessel.

Figure 9:
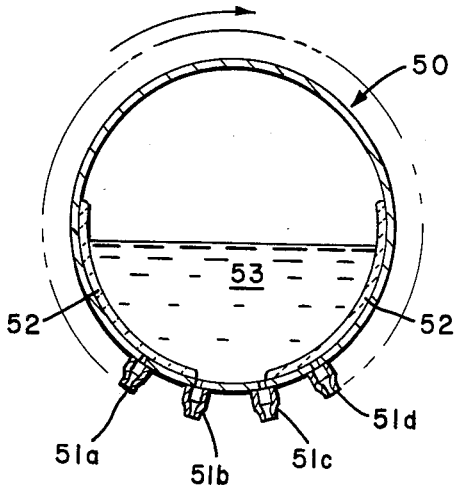
FIG. 9 is a sectional view of another embodiment of the apparatus of this invention.

FIG. 9 shows a cross section of an embodiment of the invention in which the vessel rotates about a horizontal axis. Vessel 50 has nozzles 51*a*, 51*b*, 51*c*, 51*d*, . . . mounted around its circumference. Shield 52 is a refractory material that prevents molten material 53 from being cast from any but the lowest nozzle orifice or, during rotation (as shown in FIG. 9), the lowest two orifices. Shield 52 fits against the vessel interior closely enough to prevent molten material from flowing into the gap between the shield and vessel, and it remains stationary as vessel 50 rotates sequentially. Nozzles are replaced at any convenient time after casting through them has finished. Additional material may be added to the vessel as casting depletes it. A conventional chill surface (not shown) serves to solidify the material that is ejected from the orifice(s) at the bottom of the crucible.

We claim:

1. A method of continuously forming a solid structure comprising the steps of:

(a) providing a continuous stream of molten material, (b) providing a first vessel and a second vessel, each vessel having an opening at one end and an orifice at another end and having their openings adjoining each other, (c) directing the stream toward the opening in the first vessel and moving the vessels relative to the stream, whereby the stream successively passes (i) into the opening and through the orifice of the first vessel only, (ii) into the openings and through the orifices of both the first and second vessels, and (iii) into the opening and through the orifice of the second vessel only, and (d) chilling the molten material that emerges from the orifices to effect quenching and solidification of the material.

2. The method of claim 1 in which an orifice is heated before the molten material passes through it.

3. A method for continuously forming a continuous solid structure comprising the method of claim 1 in which chilling is accomplished by a moving chill surface, and the orifice of the first vessel is separated from that of the second vessel in the direction of chill surface motion, whereby material emerging from the second orifice deposits onto material deposited from the first orifice during the time when material emerges from both orifices.

4. The method of claim 3 in which more than two vessels are arrayed in succession, with the opening in each vessel adjoining the opening in each adjacent vessel.

5. The method of claim 1 in which the material comprises metal.

6. The method of claim 5 in which the material is a metal alloy and the chilling is accomplished rapidly to yield an alloy that is at least 50% amorphous.

7. A method for continuously forming a solid structure comprising the steps of:

(a) providing molten material in a vessel that has an opening at one end and is adapted for fluid communication with a plurality of orifices at another end, (b) controlling the flow of molten material out of the vessel and through the orifices to successively provide a flow of molten material from (i) a first orifice only, (ii) the first orifice and an adjacent second orifice, and (iii) the second orifice only, and (c) chilling the molten material that emerges from the orifices to effect quenching and solidification.

8. A method for continuously forming a continuous solid structure comprising the method of claim 7 in which chilling is accomplished by a moving chill surface, and the first orifice is separated from the second orifice in the direction of chill surface motion, whereby material emerging from the second orifice deposits onto material deposited from the first orifice during the time when material emerges from both orifices.

9. The method of claim 7 in which an orifice is heated before the molten material passes through it.

10. The method of claim 7 in which the orifices are spaced circumferentially around a plate that abuts the bottom of the vessel, and flow of molten material is controlled by rotating the plate under a second opening in the bottom of the vessel.

11. The method of claim 7 in which the material comprises metal.

12. The method of claim 11 in which the material is a metal alloy and the chilling is accomplished rapidly to yield an alloy that is at least 50% amorphous.

13. An apparatus for continuously forming a solid structure comprising:

(a) a plurality of vessels, each having an opening at one end in fluid communication with an orifice at another end, with the opening in each vessel adjoining the opening in each adjacent vessel, (b) means for directing a continuous stream of molten material and for moving the vessels relative to the stream, whereby the stream successively passes (i) into the opening and through the orifice of a first vessel only, (ii) into the openings and through the orifices of both the first vessel and a second vessel, and (iii) into the opening and through the orifice of the second vessel only, and (c) means for chilling the molten material that emerges from the orifices to effect quenching and solidification of the material.

14. An apparatus for continuously forming a continuous solid structure comprising the apparatus of claim 13 in which the chilling means comprises a moving chill surface in which vessel orifices are separated in the direction of chill surface movement.

15. The apparatus of claim 13 further comprising means for heating the orifice of a vessel before molten material passes through it.

16. The apparatus of claim 13 in which the chilling means is a gas jet.

17. The apparatus of claim 14 in which each vessel is adapted for holding molten metal and the chill surface is adapted for rapidly quenching molten metal.

18. The apparatus of claim 14 in which the moving chill surface is an endless belt.

19. The apparatus of claim 14 in which the moving chill surface is a rotating wheel.

20. An apparatus for continuously forming a solid structure comprising:

(a) a vessel that is adapted for holding-molten material and that has an opening at one end and is adapted for fluid communication with a plurality of orifices at another end, (b) means for controlling the flow of molten material out of the vessel and through the orifices to successively provide a flow of molten material from (i) a first orifice only (ii) the first orifice and an adjacent second orifice, and (iii) the second orifice only, and (c) means for chilling the molten material that emerges from the orifices to effect quenching and solidification, wherein said chilling means comprises a moving chill surface and the first and second orifices are separtated in the direction of chill surface motion.

21. The apparatus of claim 20 in which the vessel is adapted for holding molten metal and the chill surface is adapted for rapidly quenching molten metal.

22. The apparatus of claim 21 in which the vessel has a bottom, having a second opening, and in which the means for controlling flow of molten material through the orifices comprises a rotatably mounted plate that abuts the bottom and is adapted for successively bringing replaceable orifices into fluid communication with the second opening.

23. The apparatus of claim 21 in which the vessel has a bottom and is rotatable about a vertical axis, and the plurality of orifices are replaceably mounted in the bottom.

24. The apparatus of claim 23 further comprising heating means adapted for heating an orifice prior to casting from that orifice.

25. The apparatus of claim 23 in which means for controlling flow of molten material through the orifices comprises at least one stopper rod mounted within the vessel.

26. The apparatus of claim 25 in which a first stopper rod is adapted to prevent flow from an orifice prior to the orifice being rotated into a position for casting and a second stopper rod is adapted to prevent flow from an orifice after it is rotated from the position for casting.

27. The apparatus of claim 23 further comprising means for cooling an orifice after casting from that orifice.

28. The apparatus of claim 21 in which the vessel has replaceably mounted around its circumference a plurality of orifices that may successively be brought into proximity to the chill surface by rotation of the vessel around a horizontal axis.

29. The apparatus of claim 28 further comprising inside the vessel a stationary shield that prevents molten material in the vessel from contacting orifices that are not in proximity to the chill surface.

* * * * *